US009022310B2

(12) United States Patent
Huang

(10) Patent No.: US 9,022,310 B2
(45) Date of Patent: May 5, 2015

(54) DESKTOP ADHESIVE TAPE DISPENSER

(76) Inventor: Harrison Huang, Taichung (TW)

( * ) Notice: Subject to any disclaimer, the term of this patent is extended or adjusted under 35 U.S.C. 154(b) by 229 days.

(21) Appl. No.: 13/618,343

(22) Filed: Sep. 14, 2012

(65) Prior Publication Data

US 2014/0077022 A1 Mar. 20, 2014

(51) Int. Cl.
*B65H 35/00* (2006.01)

(52) U.S. Cl.
CPC ..... *B65H 35/0073* (2013.01); *B65H 35/0026* (2013.01); *B65H 2406/30* (2013.01)

(58) Field of Classification Search
CPC ..... B65H 35/0026
USPC ..... 242/406, 588, 570, 588.3, 588.6, 590, 242/592, 597, 597.1, 597.4, 597.5, 597.8, 242/598, 598.3, 598.4, 598.5; 225/6, 7
See application file for complete search history.

(56) References Cited

U.S. PATENT DOCUMENTS 2,221,213 A * 11/1940 Borden ..... 225/25
2,305,592 A * 12/1942 Anderson ..... 225/12
2,309,093 A * 1/1943 Borden ..... 493/328
2,579,149 A * 12/1951 Krueger et al. ..... 225/46
3,489,324 A * 1/1970 Stohl ..... 225/37
3,508,692 A * 4/1970 Holtan ..... 225/7
3,727,868 A * 4/1973 Buchanan ..... 248/205.3
3,892,369 A * 7/1975 Fujawa ..... 242/597.4
4,012,007 A * 3/1977 Cunningham ..... 242/597.7
4,059,210 A * 11/1977 Deering, Jr. ..... 225/47
6,311,923 B1 * 11/2001 Tsai ..... 242/598.5
6,371,403 B1 * 4/2002 Shen ..... 242/598.2
6,651,857 B1 * 11/2003 Tsai ..... 225/42
6,688,549 B1 * 2/2004 Shen ..... 242/588
6,808,090 B2 * 10/2004 Pedersen ..... 222/181.3
6,974,060 B2 * 12/2005 Gomes et al. ..... 225/34
6,988,690 B2 * 1/2006 Hsu ..... 242/588.6
7,207,368 B1 * 4/2007 Lyman, Jr. ..... 156/523
7,469,868 B2 * 12/2008 Bury ..... 248/205.8
7,661,638 B2 * 2/2010 Yu ..... 248/205.8
8,104,809 B1 * 1/2012 Mayhugh ..... 294/187
2005/0236538 A1 * 10/2005 Schmidt et al. ..... 248/205.5
2008/0217493 A1 * 9/2008 Bevirt ..... 248/163.1
2011/0297716 A1 * 12/2011 Mo ..... 224/559
2012/0275141 A1 * 11/2012 Keith ..... 362/158
2013/0341346 A1 * 12/2013 Kling ..... 221/283

* cited by examiner

*Primary Examiner* — Emmanuel M Marcelo
*Assistant Examiner* — Justin Stefanon
(74) *Attorney, Agent, or Firm* — Muncy, Geissler, Olds & Lowe, P.C.

(57) ABSTRACT

A desktop dispenser includes a stationary base including a bottom member defining a bottom open chamber, a vacuum mount including a suction disc positioned in the bottom open chamber and an actuation rod extended from the top wall of the suction disc, and a carrier coupled to the stationary base and biasable between a first position and a second position. When the carrier is in the first position, the actuation rod of the vacuum mount is in an initial position; when the carrier is in the second position, the driving member lifts the actuation rod of the vacuum mount to an acting position. Thus, the desktop tape dispenser can be adhered to the top of a desk.

18 Claims, 9 Drawing Sheets

DESKTOP ADHESIVE TAPE DISPENSER

BACKGROUND OF THE INVENTION

1. Field of the Invention

The present invention relates to tape dispenser and more particularly, to a desktop tape dispenser that can be adhered to the top of a desk a vacuum.

2. Description of the Related Art

Conventional desktop tape dispensers commonly comprise a stationary base for positioning on the top of a desk. The stationary base comprises an upward-facing groove, an axle horizontally positioned in the upward-facing groove for supporting a roll of adhesive tape in a rotatable manner. By means of the gravity weight of the stationary base, the desktop tape dispenser can be steadily positioned on the top of a desk for allowing the user to pull out the adhesive tape subject to the desired length and to cut off the extended adhesive tape by a cutter blade at the stationary base.

However, when the user is pulling out the adhesive tape, the applied force may drag the desktop tape dispenser to move on the top of the desk without rotating the roll of adhesive tape relative to the stationary base. When this condition occurs, the user needs to hold down the desktop adhesive tape dispenser with one hand and to pull out the adhesive tape with the other hand, avoiding displacement of the desktop adhesive tape dispenser.

In other words, when using a conventional desktop tape dispenser, the user usually needs to use the both hands to dispense the adhesive tape. This adhesive tape dispensing manner is complicated. An improvement in this regard is necessary.

SUMMARY OF THE INVENTION

The present invention has been accomplished under the circumstances in view. It is the main object of the present invention to provide a desktop adhesive tape dispenser, which can be adhered to the top of a desk by vacuum suction, allowing the user to dispense the adhesive tape conveniently without causing displacement of the desktop adhesive tape dispenser.

To achieve this and other objects of the present invention, a desktop tape dispenser comprises a stationary base comprising a bottom member and a bottom open chamber in the bottom member, a vacuum mount comprising a suction disc positioned in the bottom open chamber and an actuation rod extended from the top wall of the suction disc, and a carrier pivotally coupled to the stationary base and biasable relative to the stationary base between a first position and a second position. The carrier comprises a driving member and an axle for supporting a roll of adhesive tape. When the carrier is in the first position, the actuation rod of the vacuum mount is in an initial position. When the carrier is in the second position, the driving member lifts the actuation rod of the vacuum mount to an acting position.

Thus, when the bottom member of the desktop tape dispenser is placed on the top of a desk, the bottom open chamber faces toward the top of the desk in an open condition, enabling the suction disc to be positioned on the top of the desk. When the carrier is in the first position, the suction disc is kept in contact with the surface of the top of the desk slightly, allowing the user to move the desktop adhesive tape dispenser on the top of the desk. After the user moved the desktop adhesive tape dispenser on the top of the desk to the desired location, the user can bias the carrier to the second position to lift the actuation rod of the vacuum mount to the acting position, causing the suction disc to be adhered to the top of the desk. Thus, the desktop tape dispenser is firmly secured to the top of the desk in position, allowing the user to dispense the adhesive tape with one single hand conveniently.

Other advantages and features of the present invention will be fully understood by reference to the following specification in conjunction with the accompanying drawings, in which like reference signs denote like components of structure.

DETAILED DESCRIPTION OF THE INVENTION

At first, the applicant must explain that, in the following embodiments and annexed drawings, like reference numbers represent like components or structural features. Secondly, when referring to "mounting one component at another" means a first component is directly attached to a second component, or the first component is indirectly attached the second component with one or more other components set therebetween. When referring to "directly" attaching one component to another component, it means no any other component set between these two components.

Figure 1:
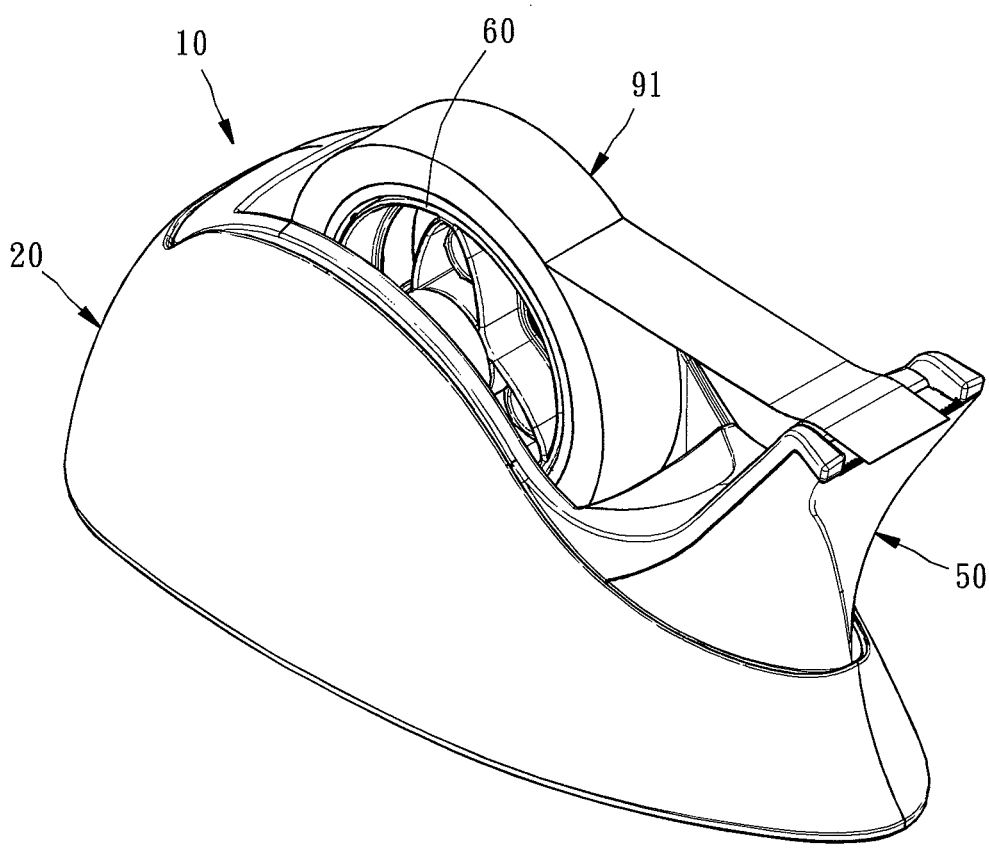
FIG. 1 is an elevational view of a desktop adhesive tape dispenser in accordance with the present invention.
Figure 2:
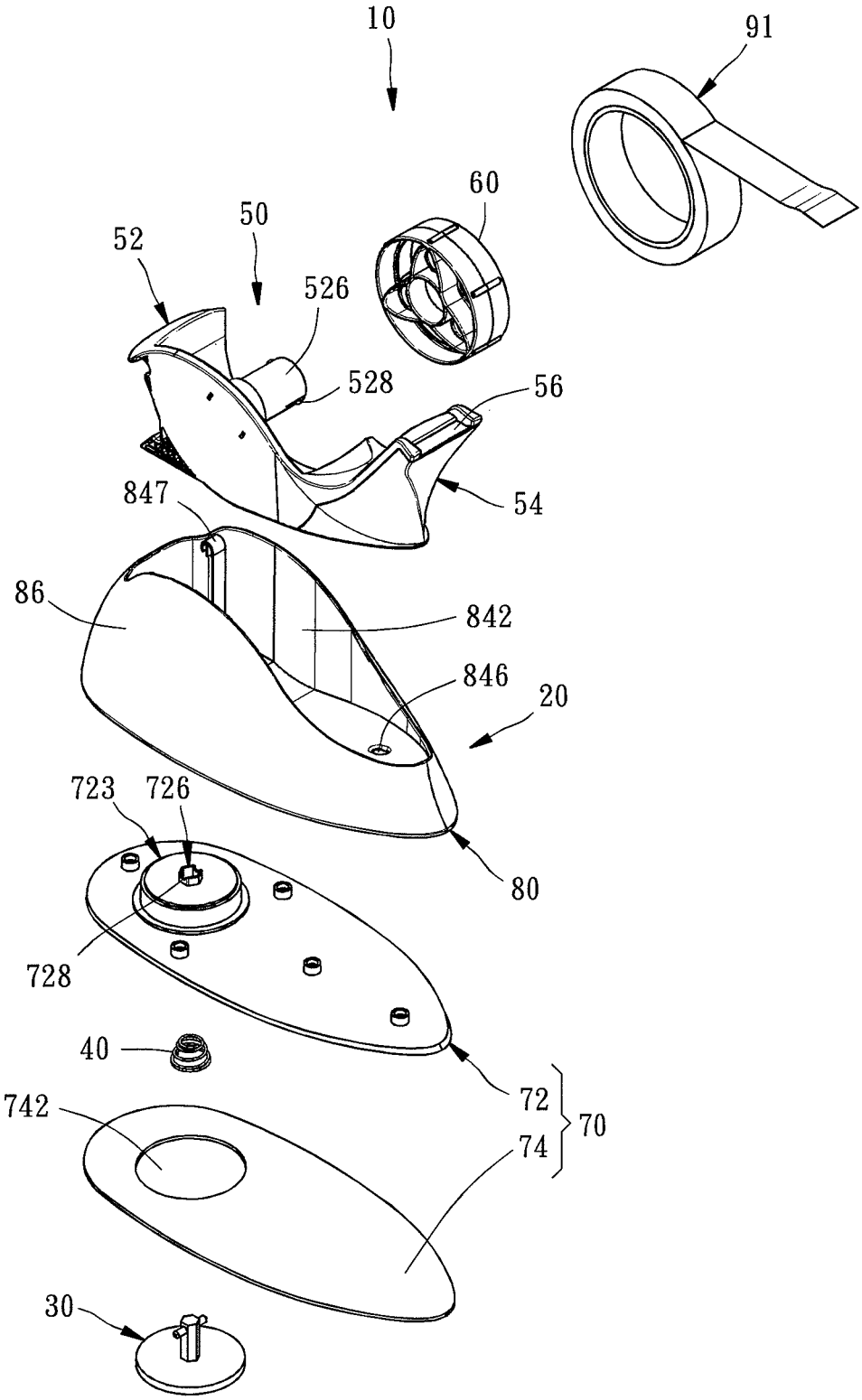
FIG. 2 is an exploded view of the desktop adhesive tape dispenser in accordance with the present invention.
Figure 3:
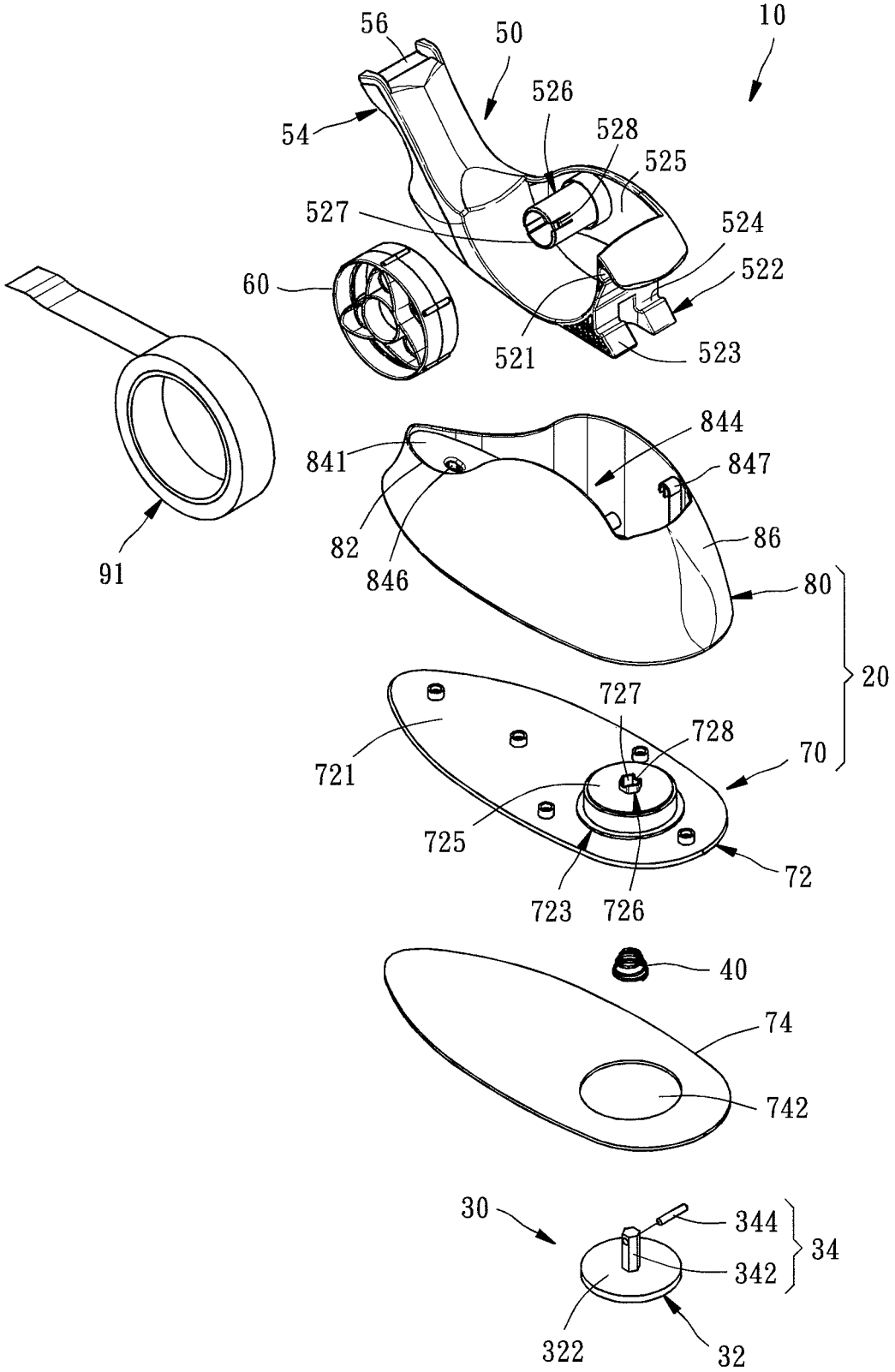
FIG. 3 corresponds to FIG. 2 when viewed from another angle.

Referring to FIGS. 1-3, a desktop tape dispenser in accordance with the present invention is shown. The desktop adhesive tape dispenser 10 comprises a stationary base 20, a vacuum mount 30, a spring member 40, a carrier 50, and a roller 60.

The stationary base 20 comprises a bottom member 70 for positioning on the top of a desk, and a holder shell 80 located on the top side of the bottom member 70. The bottom member 70 comprises a bottom plate 72 and an anti-slip pad 74.

Figure 4:
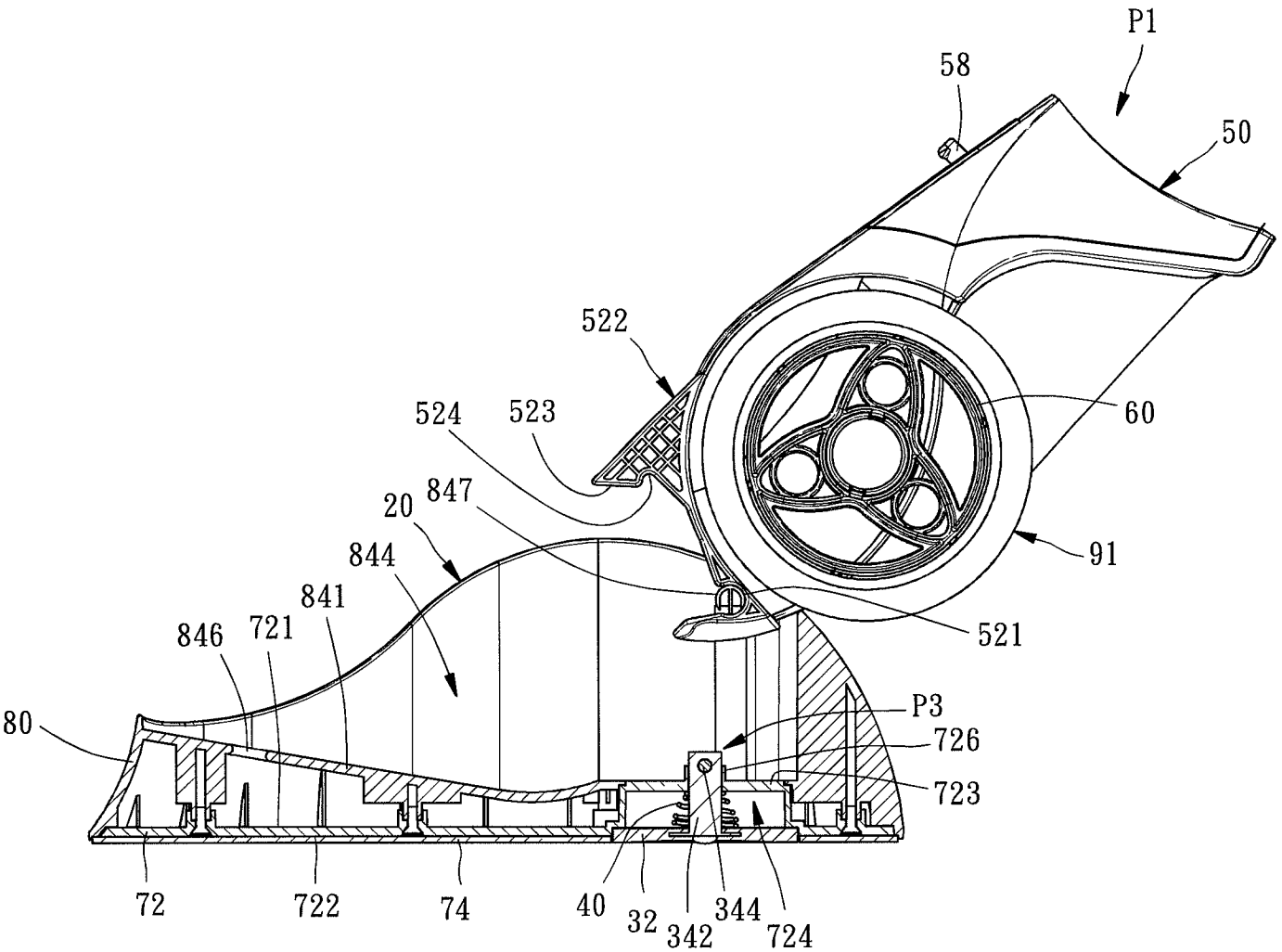
FIG. 4 is a sectional view of the present invention, illustrating the carrier of the desktop adhesive tape dispenser in the first position.

The bottom plate 72 comprises opposing top wall 721 and bottom wall 722 (see FIG. 4), a raised shell 723 protruding from the top wall 721, a bottom open chamber 724 formed in the bottom wall 722 and surrounded by the shell 723 (see FIG. 4), an upright stub tube 726 upwardly extended from a top surface 725 of the shell 723, a tube hole 727 defined in the stub tube 726 in communication with the bottom open chamber 724, and two arched notches 728 on the topmost edge of the upright stub tube 726 at two opposite sides.

Figure 5:
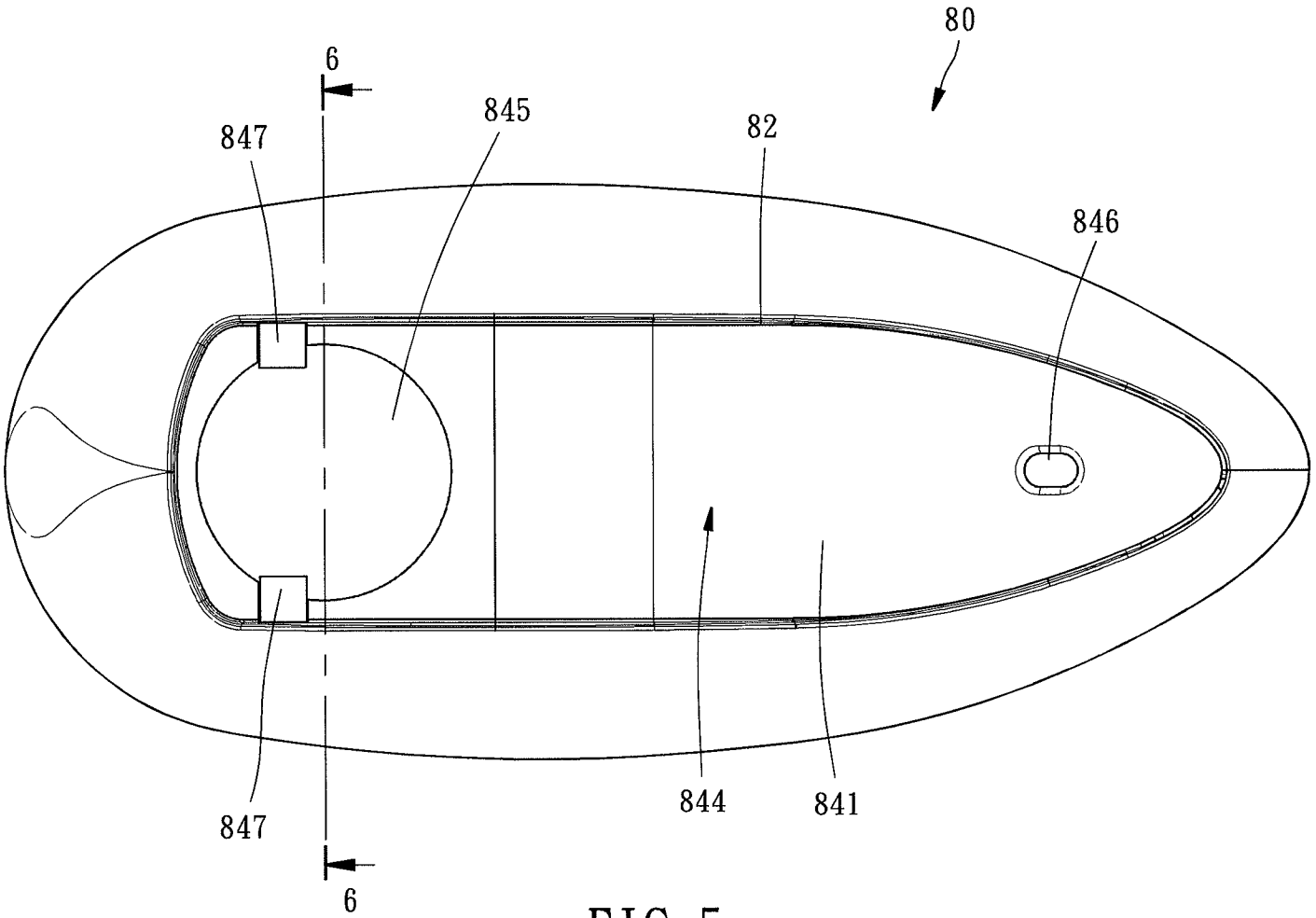
FIG. 5 is a top view of the holder shell of the stationary base of the desktop adhesive tape dispenser in accordance with the present invention.
Figure 6:
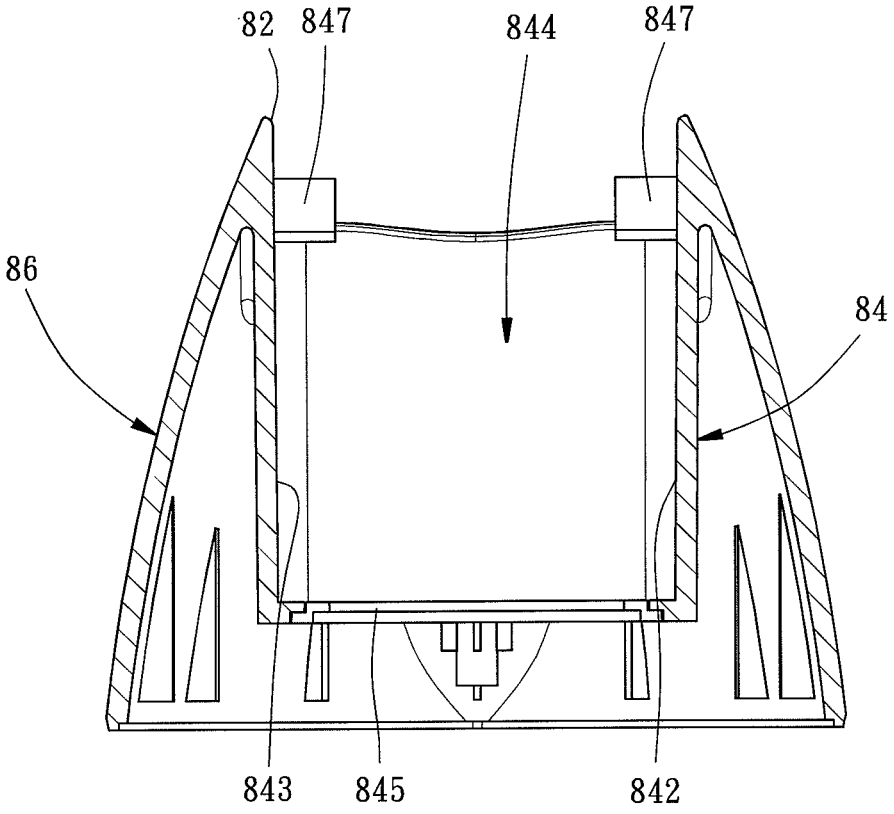
FIG. 6 is a sectional view taken along line 6-6 of FIG. 5.

Referring also to FIGS. 5 and 6, the holder shell 80 comprises a top opening 82, an inner perimeter 84 downwardly extended from the top opening 82 and defining an inner bottom wall 841 and two upright sidewalls 842;843, an outer perimeter 86 surrounding the inner perimeter 84, an accommodation space 844 surrounded by the inner bottom wall 841 and the upright sidewalls 842;843 in communication with the top opening 82, a big round hole 845 and a small locating hole 846 cut through the inner bottom wall 841, and two pivots 847 respectively extended from the upright sidewalls 842;843 and suspending above the big round hole 845.

The holder shell 80 is affixed to the top wall 721 of the bottom plate 72 by screws to keep the raised shell 723 in the big round hole 845. Thereafter, the anti-slip pad 74 is bonded to the bottom wall 722 of the bottom plate 72. The anti-slip pad 74 has a through hole 742 corresponding to the bottom open chamber 724 of the bottom plate 72 so that when the stationary base 20 is placed on the top of a desk, the bottom open chamber 724 faces toward the top of the desk in an open condition.

Figure 7:
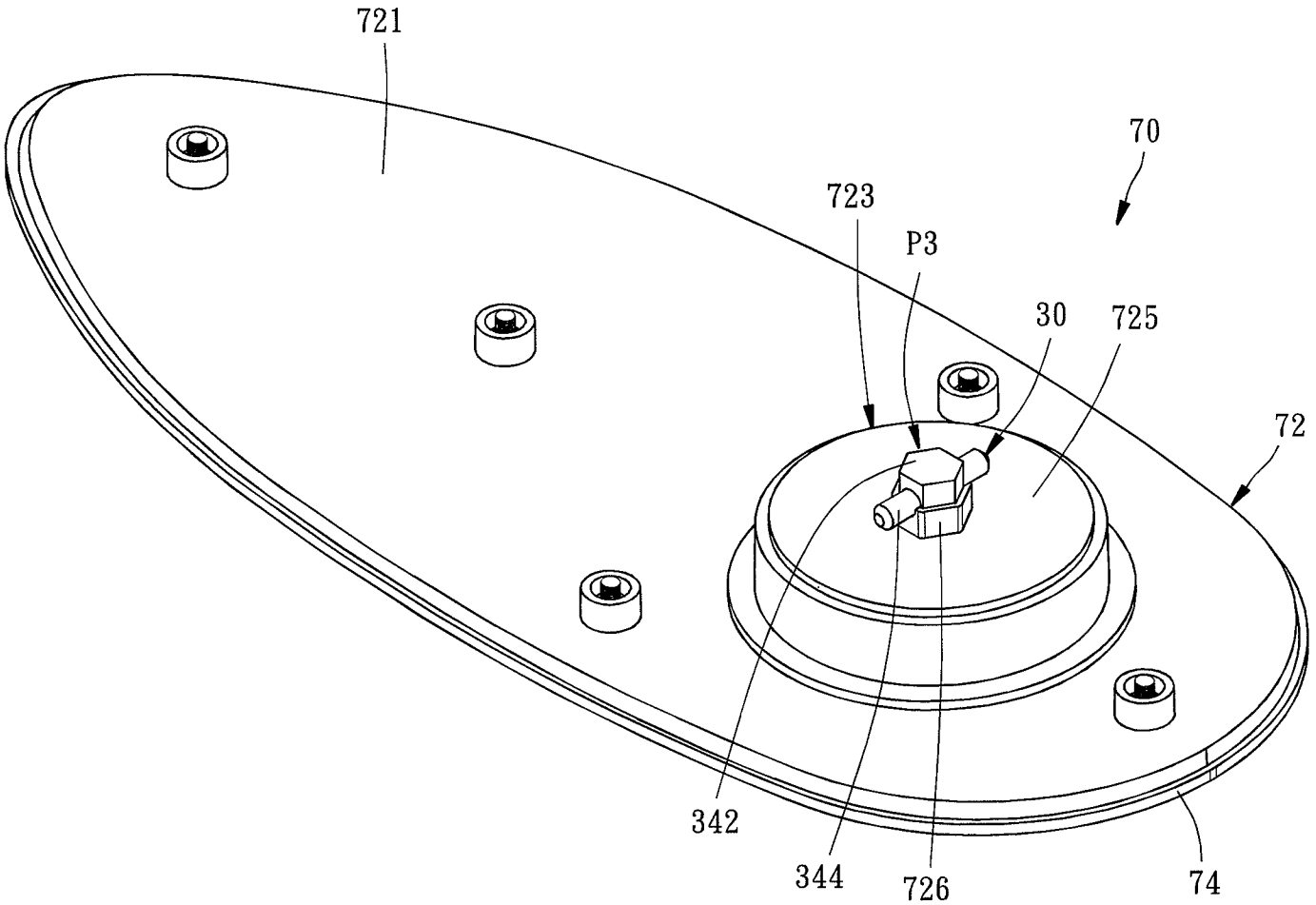
FIG. 7 is an elevational view of the bottom member and vacuum mount of the stationary base of the desktop adhesive tape dispenser in accordance with the present invention.

Referring to FIG. 7 and FIGS. 3 and 4 again, the vacuum mount 30 comprises a suction disc 32, and an actuating rod 34 upwardly extended from a top wall 322 of the suction disc 32. The actuation rod 34 comprises a vertical rod 342 fixedly connected to the top wall 322 of the suction disc 32, and a transverse rod 344. The spring member 40 is mounted around the vertical rod 342 and then accommodated with the suction disc 32 in the bottom open chamber 724 of the bottom plate 72 of the stationary base 20, and then the transverse rod 344 is inserted through the vertical rod 342 and positioned in the arched notches 728 of the upright stub tube 726. Thus, the stationary base 20, the vacuum mount 30 and the spring member 40 are assembled together, and the transverse rod 344 of the vacuum mount 30 is kept in the accommodation space 844 of the inner perimeter 84 of the holder shell 80.

Referring to FIGS. 2-4 again, the carrier 50 comprises a carrier body 52 fitting the configuration of the accommodation space 844 of the inner perimeter 84 of the holder shell 80 (see FIG. 6), a cutter holder 54 obliquely upwardly extended from one end of the carrier body 52 and fixedly holding a cutter blade 56, an open-ended pivot hole 521 transversely located on an opposite end of the carrier body 52, a driving member 522 located on the opposite end of the carrier body 52 adjacent to the bottom side of the open-ended pivot hole 521 and defining two bevel faces 523 and an arched positioning groove 524 at one end of each of the two bevel faces 523, an axle 526 extended from one sidewall 525 of the carrier body 52 and having a free end 527 and two elastic blocks 528 at two opposite sides of the free end 527, and a positioning post 58 disposed at the bottom side of the cutter holder 54.

Figure 8:
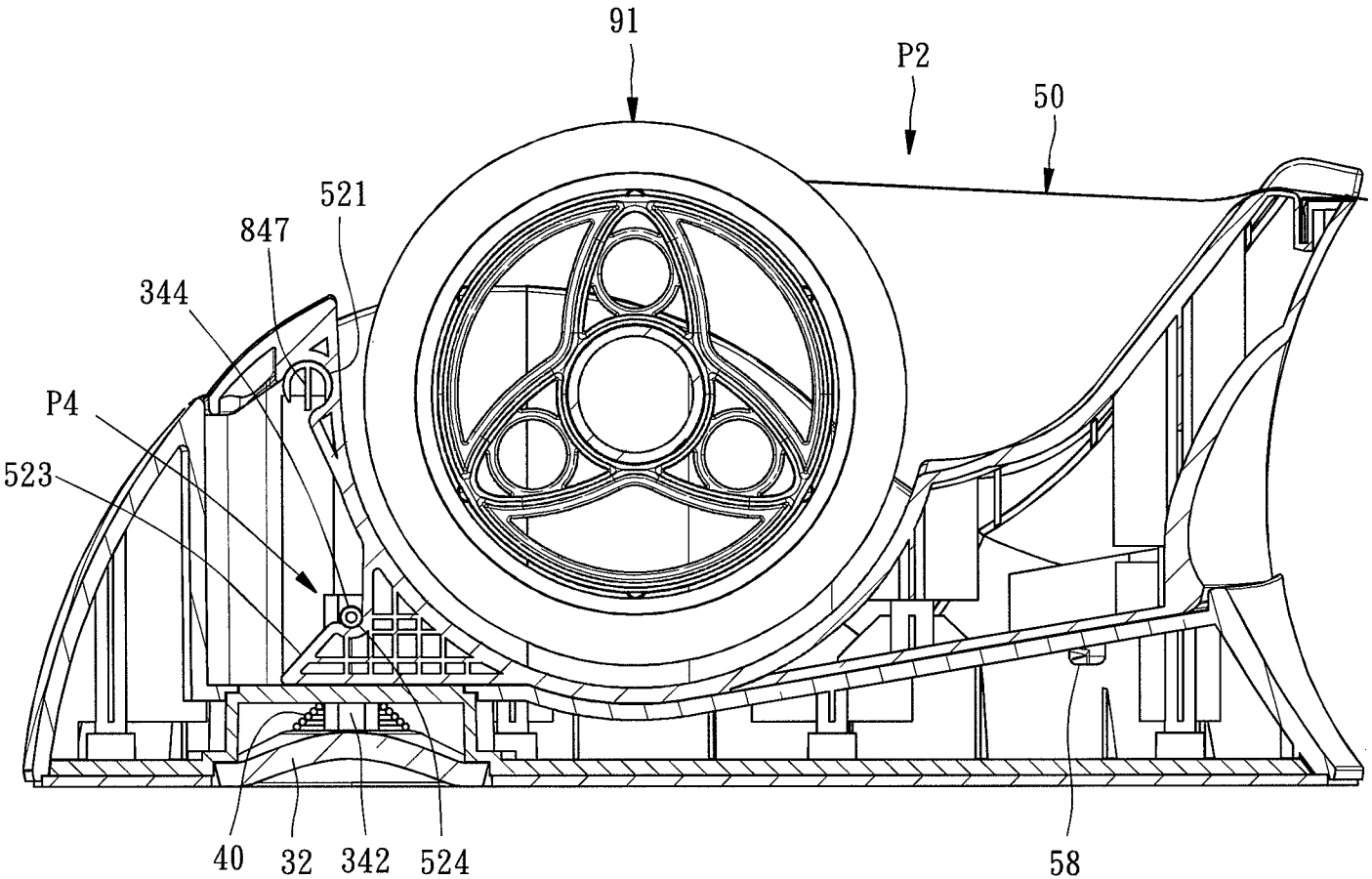
FIG. 8 is a sectional view of the present invention, illustrating a roll of adhesive tape mounted in the desktop adhesive tape dispenser and the carrier moved to the second position.

The open-ended pivot hole 521 of the carrier 50 is pivotally coupled to the pivots 847 of the stationary base 20 so that the carrier 50 can be biased relative to the stationary base 20 between a first position P1 (see FIG. 4) and a second position P2 (see FIG. 8).

Figure 9:
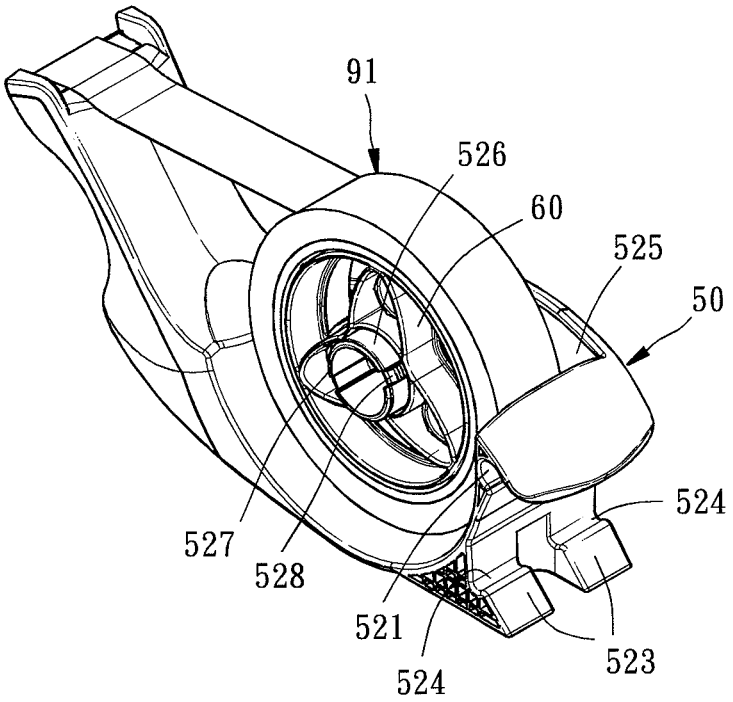
FIG. 9 is an elevational view of a part of the present invention, illustrating a roller of adhesive tape mounted on a roller at the axle in the carrier of the desktop adhesive tape dispenser.

Referring to FIG. 9 and FIG. 4 again, when the carrier 50 is moved to the first position P1, the major part of the carrier 50 is disposed outside the accommodation space 844 of the holder shell 80. At this time, the roller 60 can be sleeved from the free end 527 onto the axle 526 for holding a roll of adhesive tape 91. The roller 60 is loosely and rotatably supported on the axle 526 between the elastic blocks 528 and the sidewall 525, and therefore the roller 60 is prohibited by the elastic blocks 528 from falling out of the axle 526. The roll of adhesive tape 91 is press-fitted onto the roller 60, and therefore the roll of adhesive tape 91 can be rolled with the roller 60. Further, when the carrier 50 is in the first position P1, the driving member 522 is kept apart from the vacuum mount 30. At this time, the actuation rod 34 of the vacuum mount 30 is in an initial position P3.

Referring also to FIG. 8, when biasing the carrier 50 from the first position P1 to the second position P2, the transverse rod 344 of the vacuum mount 30 will move along the bevel faces 523 of the driving member 522 of the carrier 50 toward the arched positioning grooves 524 to lift the vertical rod 342. Thus, when the carrier 50 reached the second position P2, the transverse rod 344 is positioned in the arched positioning grooves 524 and pushed upward by the driving member 522 to hold the actuation rod 34 in an acting position P4. Further, when the carrier 50 is in the second position P2, the free end 527 of the axle 526 is aimed at the upright sidewall 842 of the stationary base 20 (see FIG. 2), and the roll of adhesive tape 91 is restricted to the space between the upright sidewall 842 of the stationary base 20 and the sidewall 525 of the carrier 50 and prohibited from escaping out of the roller 60. Further, when the carrier 50 is in the second position P2, the positioning post 58 of the carrier 50 is inserted into the small locating hole 846 of the stationary base 20, prohibiting vibration of the carrier 50 relative to the stationary base 20. However, the positioning post 58 and the small locating hole 846 can be respectively eliminated from the carrier 50 and the stationary base 20 without affecting normal functioning of the desktop adhesive tape dispenser 10.

Figure 10:
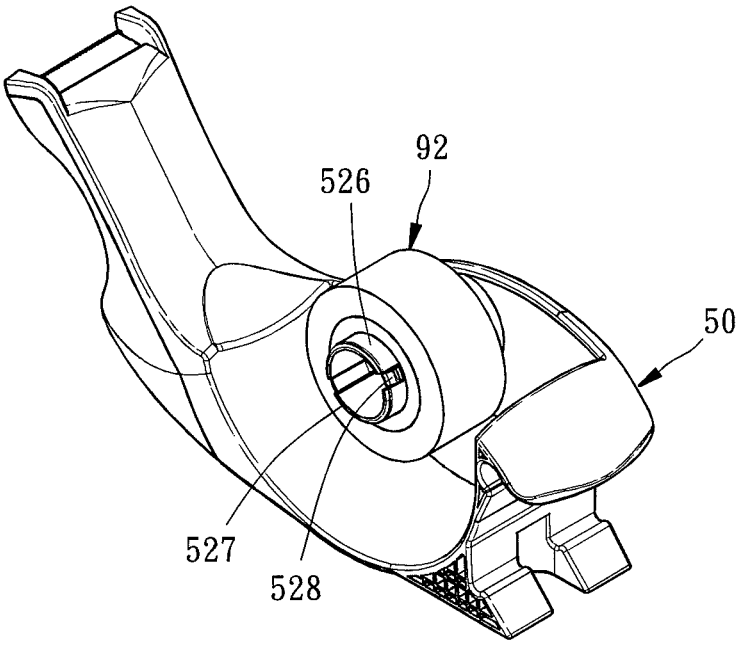
FIG. 10 is an elevational view of a part of the present invention, illustrating a roll of adhesive tape directly supported on the axle of the carrier of the adhesive tape dispenser.

Referring to FIG. 10, the roller 60 of the desktop adhesive tape dispenser 10 can be omitted, allowing a roll of adhesive tape 92 having a relatively smaller inner diameter to be rotatably mounted on the axle 526 and held in position by the elastic blocks 528 of the axle 526.

It is worth mentioning that the axle 526 of the carrier 50 can be configured without the elastic blocks 528, and the upright sidewall 842 of the stationary base 20 and the sidewall 525 of the carrier 50 are configured to limit the positioning of the roller 60 and roll of adhesive tape 91, or the roll of adhesive tape 92. Further, when the actuation rod 34 of the vacuum mount 30 is separated from the driving member 522 of the carrier 50, the actuation rod 34 immediately returns to its initial position P3 subject to the effect of its gravity weight, and the elastic restoring force provided by the spring member 40 assists the actuation rod 34 to return to the initial position P3. However, it is to be understood that the desktop adhesive tape dispenser 10 can be configured without the spring member 40.

If the actuation rod 34 of the vacuum mount 30 is in the initial position P3 (for example, the carrier 50 is in the first position P1) during the use of the desktop adhesive tape dispenser 10, the suction disc 32 is slightly kept in contact with the top of the desk. At this time, the user can move the desktop adhesive tape dispenser 10 along the top of the desk to the desired location. Thereafter, the user can bias the carrier 50 to the second position P2 to lift the actuation rod 34 of the vacuum mount 30 to the acting position P4. At this time, the outer edge of the suction disc 32 is kept abutted against the top of the desk, creating an airtight effect. At the same time, the center area of the suction disc 32 is lifted, increasing the enclosed space between the suction disc 32 and the top of the desk and reducing the pressure in this enclosed space, and therefore the suction disc 32 is firmly adhered to the top of the desk. Further, the anti-slip pad 74 provides an anti-slip function and also creates an airtight effect around the suction disc 32 to enhance the suction effect of the suction disc 32. Thus, the desktop adhesive tape dispenser 10 can be firmly secured to the top of the desk at the desired location, allowing the user to dispense the adhesive tape with one single hand conveniently.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A desktop tape dispenser, comprising:

a stationary base comprising a bottom member, said bottom member comprising a bottom open chamber;

a vacuum mount mounted in said stationary base, said vacuum mount comprising a suction disc positioned in said bottom open chamber and an actuation rod extended from a top wall of said suction disc; and a carrier pivotally coupled to said stationary base and biasable relative to said stationary base between a first position and a second position, said carrier comprising a driving member and an axle for supporting a roll of adhesive tape, said carrier and said driving member rotating about a common driving axis;

wherein when said carrier is in said first position, said actuation rod of said vacuum mount is in an initial position; when said carrier is in said second position, said driving member lifts said actuation rod of said vacuum mount to an acting position;

wherein said actuation rod of said vacuum mount comprises a vertical rod extended from the top wall of said suction disc and a transverse rod affixed to said vertical rod, said transverse rod being pushed upwards by said driving member when said carrier is moved to said second position;

wherein said driving member of said carrier comprises a bevel face adapted to guide said transverse rod of said vacuum mount upwards when said carrier is biased from said first position toward said second position; and wherein when the carrier pivots to the second position from the first position, the driving member of the carrier engages the vertical rod and upwardly contacts against the transverse rod to make the transverse rod of the vacuum mount slide upwardly along the bevel face to an acting position.

2. The desktop tape dispenser as claimed in claim 1, wherein said driving member of said carrier further comprises an arched positioning groove disposed at one side relative to said bevel face; said transverse rod of said vacuum mount is positioned in said arched positioning groove when said transverse rod of said carrier is in said second position.

3. The desktop tape dispenser as claimed in claim 2, wherein said bottom member of said stationary base comprises an anti-slip pad, said anti-slip pad comprising a through hole corresponding to said bottom open chamber.

4. The desktop tape dispenser as claimed in claim 3, wherein said carrier comprises a sidewall; said axle extends from the sidewall of said carrier, comprising a free end; said roll of adhesive tape is sleeved from said free end onto said axle when said carrier is in said first position; said free end of said axle is aimed at one upright sidewall of said stationary base to limit the positioning of said roll of adhesive tape between the upright sidewall of said stationary base and the sidewall of said carrier when said carrier is in said second position.

5. The desktop tape dispenser as claimed in claim 4, further comprising a roller, said roller being attachable onto said axle through said free end of said axle for supporting a different roll of adhesive tape on said axle when said carrier is in said first position.

6. The desktop tape dispenser as claimed in claim 5, wherein said axle of said carrier comprises a block adapted for stopping said roller at said axle.

7. The desktop tape dispenser as claimed in claim 6, wherein said bottom member of said stationary base comprises a top wall facing toward said carrier and a shell protruded from said top wall; said bottom open chamber is defined in said shell; said actuation rod of said vacuum mount is inserted through said shell.

8. The desktop tape dispenser as claimed in claim 7, wherein said bottom member of said stationary base further comprises an upright stub tube extended from a top surface of said shell, said upright stub tube comprising a tube hole in communication with said bottom open chamber, and an arched notch; said bottom open chamber is defined in said shell; said actuation rod of said vacuum mount is inserted through said tube hole; said actuation rod of said vacuum mount is positioned in said arched notch when said actuation rod of said vacuum mount is in said initial position.

9. The desktop tape dispenser as claimed in claim 8, further comprising a spring member mounted around said actuation rod of said vacuum mount inside said bottom open chamber.

10. The desktop tape dispenser as claimed in claim 9, wherein said stationary base comprises a small locating hole; said carrier comprises a positioning post, said positioning post being inserted into said small locating hole when said carrier is in said second position.

11. The desktop tape dispenser as claimed in claim 1, wherein said bottom member of said stationary base comprises a top wall facing toward said carrier and a shell protruded from said top wall; said bottom open chamber is defined in said shell; said actuation rod of said vacuum mount is inserted through said shell.

12. The desktop tape dispenser as claimed in claim 1, wherein said bottom member of said stationary base comprises a top wall facing toward said carrier, a shell protruded from said top wall and an upright stub tube extended from a top surface of said shell, said upright stub tube defining a tube hole in communication with said bottom open chamber and an arched notch; said bottom open chamber is defined in said shell; said vertical rod of said vacuum mount is inserted through said tube hole; said transverse rod is positioned in said arched notch when said actuation rod of said vacuum mount is in said initial position.

13. The desktop tape dispenser as claimed in claim 1, further comprising a spring member mounted around said actuation rod of said vacuum mount inside said bottom open chamber.

14. The desktop tape dispenser as claimed in claim 1, wherein said stationary base comprises a small locating hole; said carrier comprises a positioning post, said positioning post being inserted into said small locating hole of said stationary base when said carrier is in said second position.

15. The desktop tape dispenser as claimed in claim 1, wherein said carrier comprises a sidewall; said axle extends from the sidewall of said carrier, comprising a free end; said roll of adhesive tape is sleeved from said free end onto said axle when said carrier is in said first position; said free end of said axle is aimed at one upright sidewall of said stationary base to limit the positioning of said roll of adhesive tape between the upright sidewall of said stationary base and the sidewall of said carrier when said carrier is in said second position.

16. The desktop tape dispenser as claimed in claim 15, wherein said axle of said carrier comprises a block adapted to stop said roll of adhesive tape at said axle between said block and the sidewall of said carrier.

17. The desktop tape dispenser as claimed in claim 15, further comprises a roller, said roller being attachable onto said axle through said free end of said axle for supporting a different roll of adhesive tape on said axle when said carrier is in said first position.

18. The desktop tape dispenser as claimed in claim 17, wherein said axle of said carrier comprises a block adapted for stopping said roller at said axle between said block and the sidewall of said carrier.

* * * * *